US009962667B2

(12) United States Patent
McDonnell

(10) Patent No.: US 9,962,667 B2
(45) Date of Patent: May 8, 2018

(54) STORAGE DEVICE FOR LIQUID CONTAINERS

(71) Applicant: David Keith McDonnell, Catonsville, MD (US)

(72) Inventor: David Keith McDonnell, Catonsville, MD (US)

( * ) Notice: Subject to any disclaimer, the term of this patent is extended or adjusted under 35 U.S.C. 154(b) by 62 days.

(21) Appl. No.: 15/055,438

(22) Filed: Feb. 26, 2016

(65) Prior Publication Data

US 2016/0263538 A1 Sep. 15, 2016

Related U.S. Application Data

(60) Provisional application No. 62/133,407, filed on Mar. 15, 2015.

(51) Int. Cl.

| | |
|---|---|
| ***B01F 9/02*** | (2006.01) |
| ***B01F 15/04*** | (2006.01) |
| ***B01F 9/00*** | (2006.01) |
| ***B01F 15/00*** | (2006.01) |
| *B01F 3/00* | (2006.01) |

(52) U.S. Cl.

CPC ..... *B01F 9/003* (2013.01); *B01F 9/02* (2013.01); *B01F 15/00506* (2013.01); *B01F 15/00538* (2013.01); *B01F 15/00753* (2013.01); *B01F 2003/0028* (2013.01)

(58) Field of Classification Search

CPC .... B01F 9/0014; B01F 9/0016; B01F 9/0018; B01F 9/0023; B01F 9/003; B01F 9/02; B01F 9/10

USPC ..... 366/209, 210, 211, 212, 216, 218

See application file for complete search history.

(56) References Cited

U.S. PATENT DOCUMENTS 549,961 A * 11/1895 Halley et al. ..... 366/212
814,196 A * 3/1906 Forsyth ..... B01F 11/0022 366/212
989,783 A * 4/1911 Jeffris ..... B01F 11/0022 366/212
1,015,383 A * 1/1912 Dyer et al. ..... B01F 11/0022 366/212
1,204,849 A * 11/1916 Daniel ..... B01F 11/0022 366/212
3,176,967 A * 4/1965 Hartley ..... B01F 9/0018 366/220
4,134,689 A * 1/1979 Ahrenskou-Sorensen ..... B01F 11/0031 108/147
4,568,194 A * 2/1986 Gargioni ..... B01F 9/0018 366/213

(Continued)

FOREIGN PATENT DOCUMENTS

WO WO-9108045 A1 * 6/1991 ..... B01F 9/0001

*Primary Examiner* — Joshua E Rodden

(57) ABSTRACT

Described herein is a device comprising a liquid container mounting structure and a support structure. The liquid container mounting structure securely holds liquid storage containers. The liquid container mounting structure is movably mounted to the support structure. The liquid container mounting structure may be configured to move the liquid container mounting structure relative to the support and/or include a crank handle or motor, such as an electric motor. The liquid container mounting structure is removable from the support structure to allow for reconfiguration and/or transport of the liquid container mounting structure.

13 Claims, 10 Drawing Sheets

(56) References Cited

U.S. PATENT DOCUMENTS

| | | | | | |
|---|---|---|---|---|---|
| 5,197,802 | A * | 3/1993 | Miller | B01F 9/0018 | 192/18 R |
| 5,310,257 | A * | 5/1994 | Altieri, Jr. | B01F 15/00753 | 100/219 |
| 5,458,416 | A * | 10/1995 | Edwards | B01F 9/0014 | 366/209 |
| 5,507,575 | A * | 4/1996 | Rossetti | B01F 11/0005 | 366/217 |
| 5,897,204 | A * | 4/1999 | Dittmer | B01F 15/00753 | 366/209 |
| 7,018,587 | B2 * | 3/2006 | Heath | B01L 3/50825 | 211/60.1 |
| 7,195,394 | B2 * | 3/2007 | Singh | B01F 11/0017 | 366/211 |
| 7,997,787 | B2 * | 8/2011 | Blair | B01F 11/0008 | 366/110 |
| 2002/0039327 | A1 * | 4/2002 | Kopkie | B01F 11/0017 | 366/211 |
| 2010/0074047 | A1 * | 3/2010 | Benatti | B01F 9/0001 | 366/213 |
| 2012/0051174 | A1 * | 3/2012 | Livschits | A01J 15/08 | 366/187 |

* cited by examiner

STORAGE DEVICE FOR LIQUID CONTAINERS

CROSS REFERENCE TO RELATED APPLICATIONS

The present application claims the benefit of U.S. Provisional Patent Application 62/133,407 filed on Mar. 15, 2015, entitled "STORAGE DEVICE FOR LIQUID CONTAINERS," the contents of which are hereby incorporated by reference herein.

TECHNICAL FIELD

The present disclosure relates to the storage and mixing of protective or decorative materials suspended in a liquid medium.

BACKGROUND

Over a period of time, a container of protective or decorative materials (e.g., paint, stain, varnish or the like) suspended in a liquid medium of any viscosity becomes hardened or discolored when stationary. The quick or frequent use of the liquid medium can mitigate the hardening issue. Most users, however, only use a portion of liquid at a time, while the rest remains in the container for possible later use. Frequently, the liquid medium product becomes unusable after a long period of time and discarded. The life of the liquid medium product could be extended significantly if the liquid is moved periodically or even continuously by external kinetic motions to the container.

Related art devices for the mixing of paint, etc. focus on the one-time pre-use mixing of the colorant or active ingredient into the liquid medium, not the long term sustainability of the product. The other mixing devices either require a mixing assembly placed directly into the liquid which requires cleaning or are able to only mix one container of liquid at a time.

DESCRIPTION OF EXAMPLE EMBODIMENTS

Overview

Example embodiments of the present invention relate to a paint or the like substance, storage, mixing, and carrying device and the assembly method thereof. According to example embodiments described herein is a device comprising a liquid container mounting structures, and a support structure. The liquid container mounting structure is movably mounted to the support structure. The liquid container mounting structure may be configured to move the liquid container mounting structure relative to the support structure and/or include a manual crank handle or a motor, such as an electric motor, to drive the motion of the liquid container mounting structure relative to the support structure. The liquid container mounting structure may include attachment device that allow liquid containers to be securely attached to the liquid container mounting structure, and more specifically to secure the containers to the liquid container mounting structure during the motion of the container mounting structure. For example, a liquid container mounting structure may comprise a lower member and an upper member between which the liquid containers may be securely arranged. According to other example embodiments, the attachment device may comprise threaded clamps among others. Due to the motion of the liquid container mounting structure relative to the support structure, the liquid within the liquid container will move relative to the liquid container, providing kinetic energy to the liquid and preventing solidification of the liquid.

According to example embodiments, each liquid container mounting structure may hold containers of the same height to allow for uniform pressure on the container lids. The bottom portion of the liquid container mounting structure features a lip on one side to prevent container slippage when rotating or removal. The top portion of the liquid container mounting structure may contain a padded portion to aid in securing the container and also seal the container from air contamination.

According to example embodiments, the liquid container mounting structure is removable from the support structure to allow for reconfiguration of various size containers or transporting of the containers. The support structures allow for vertical stacking.

According to example embodiments, described herein is a storage, mixing, and carrying device that also keeps a liquid medium product fresh from hardening and discoloration, which would be useful to the individual homeowner as well as organizations interested in extending the life of their expensive liquid medium products.

The device described herein will optimally rotate the contents a full rotation every half to one second when mixing. When storing containers in the device for a longer period of time, a periodic half rotation of one to four times a day is the optimal frequency to enhance the longevity of the container contents.

Example Embodiments

Figure 1:
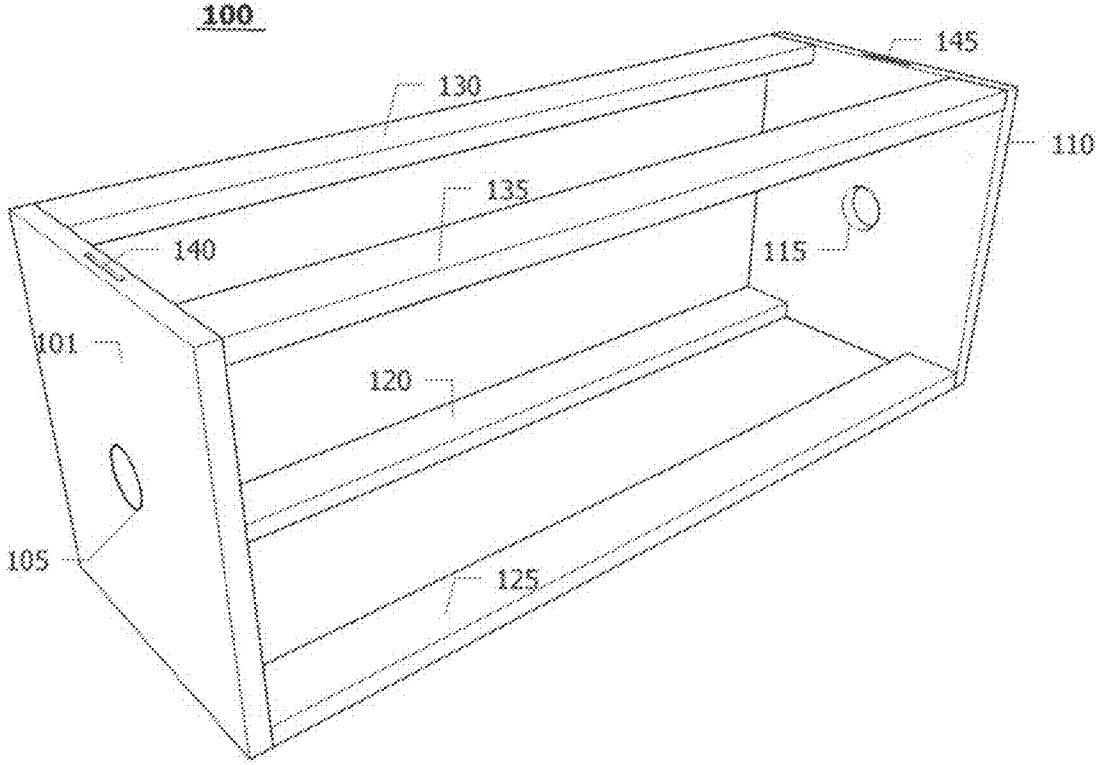
FIG. 1 illustrates the support structure, according to an example embodiment.

Depicted in FIG. 1 is a support structure 100, which may be composed of wood, plastic, metal and/or a combination thereof. Device 100 is comprised of four horizontal brace connections 120, 125, 130, and 135. The horizontal brace connections attach to vertical parts 101 and 110. Vertical part 101 contains a centered round hole 105 and vertical part 110 contains round hole 115. Holes 105 and 115 receive a ball bearing (not shown). Each vertical part 101 and 110 contain receive slots 140 and 145 on the top and corresponding slots on the bottom (not shown) used when stacking multiple units. The bottom of vertical parts 140 and 145 also feature receive slots on the bottom of each (not shown). The support structure 100 may support one or more liquid container mounting structures shown in FIG. 2.

Figure 2:
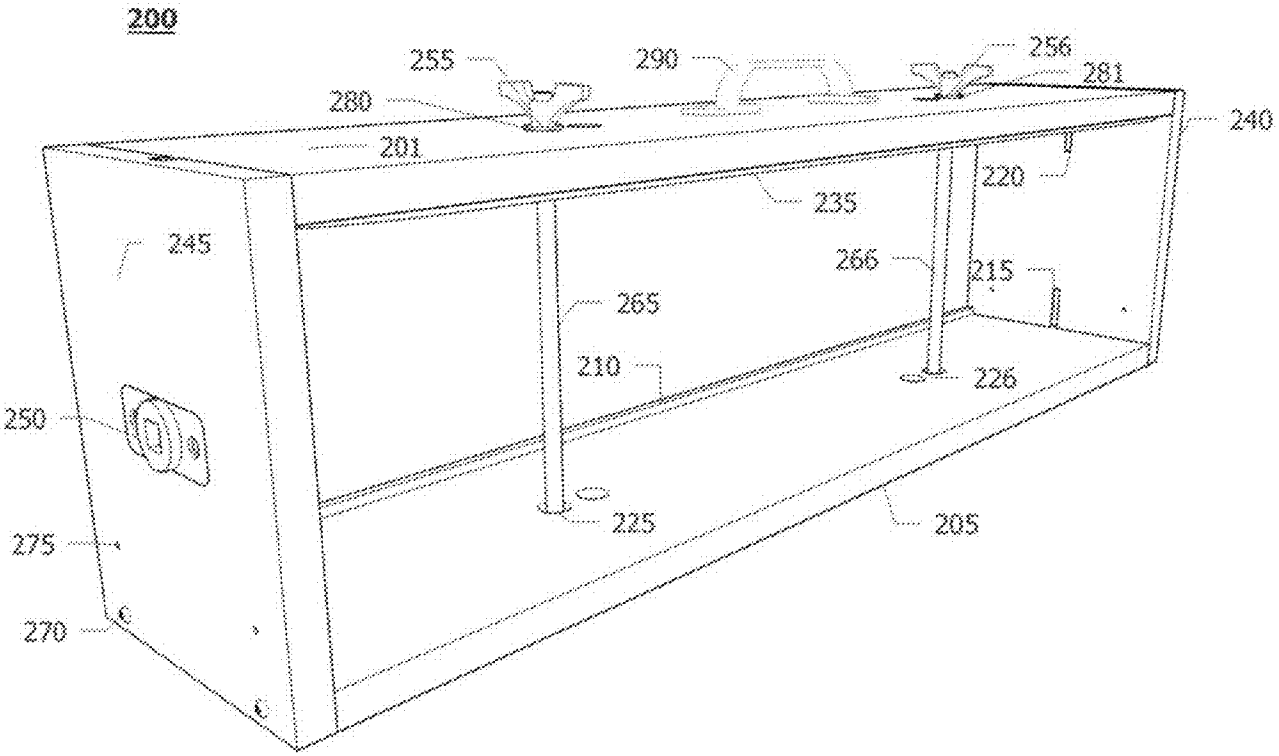
FIG. 2 illustrates a perspective view of the liquid container mounting structure configured for gallon containers, according to an example embodiment.

Depicted in FIG. 2 is a liquid container mounting structure 200 configured for gallon containers. Other example embodiments may be configured for smaller or larger sized containers, including standard quart and five gallon containers. The structure 200 contains two vertical side parts 240 and 245. Each vertical side part contains a square shaft mounting part 250 to receive a square drive shaft (not shown) and which is the rotation pivot point of the liquid container mounting structure 200 within the support structure 100. A mounting part 250 is square in shape to receive the square drive part 520 (See FIG. 5). A square drive greatly reduces any rotational slipping when a rotational force is applied to the part. Each vertical side part 240 and 245 contain holes like 275 which are at consistent elevations to secure bottom shelf part 205 perpendicular to the side parts via part 270 at adjustable elevations. Vertical side parts 240 contains a top guide groove 220 and bottom guide groove 215 into which male portion 221 of top shelf part 201 and male portion 216 of bottom shelf part 205 (see, FIG. 4) are arranged to allow top shelf part 201 and bottom shelf part 205 to move in a vertical direction relative to vertical side parts 240 and 245. Vertical side part 245 also contains guide grooves not seen in this view. For the gallon configuration the bottom shelf part 205 is fixed to side parts 240 and 245 via part 270 at the lowest setting. Bottom shelf part 205 contains four holes in which the clamping rods are placed through. Shown in the example embodiment show in FIG. 2 are the holes for the gallon configuration 225 and 226. The other two holes in the bottom shelf part 205 are used for alternate configurations. Fixed to the bottom shelf part 205 is the back lip part 210 which provides a physical stop for the containers held in the liquid container mounting structure 200. Top shelf part 201 contains hole two receive holes for the gallon configuration 280 and 281. The clamping rod 265 is inserted into holes 225 and 280 along with clamping rod 266 inserted into holes 226 and 281 for the gallon configuration. The clamping rods are offset from the edges to provide equal pressure on the containers within liquid container mounting structure. Secure nuts and washers 255 and 256 are used to apply constant pressure via secure part 265 and 266 to the containers (not shown) between top shelf part 201 and bottom shelf part 205. Attached to the top shelf part 201 is cushion part 235 which provides added motion stability to the containers held in the liquid container mounting structure 200. Cushion part 235 also provides the benefit of sealing the container lids from external air intrusion. Accordingly, cushion part 235 may also be referred to as seal 235. Attached to top shelf part 201 is a carry handle 290 to allow for transportation of the liquid container mounting structure 200 when it is removed from the support structure 100.

Figure 3:
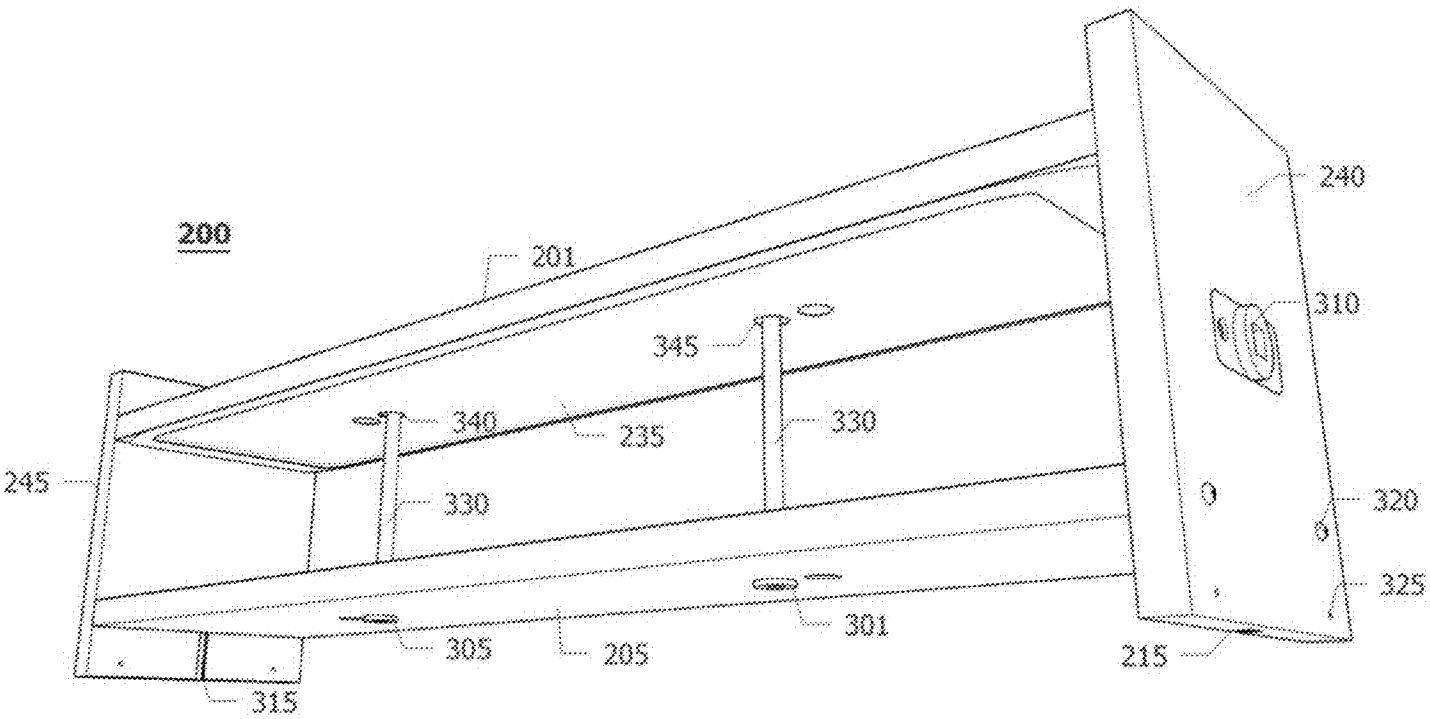
FIG. 3 illustrates a perspective view of the liquid container mounting structure configured for quart containers, according to an example embodiment.

Depicted in FIG. 3 is the opposite perspective view from FIG. 2 of the liquid container mounting structure 200 configured for quart containers. From this perspective the other square shaft mounting part 310 is shown to receive a square drive shaft (not shown). Identical holes to hole 325 are used to receive secure part 320 to secure bottom shelf part 205 to vertical parts 240 and 245 at the higher setting. The groove guide 315 on vertical side part 245 to guide the bottom shelf part 205 can be seen from the perspective. The clamping rod 330 is inserted into holes 305 and 340 along with clamping rod 331 inserted into holes 301 and 345 for the quart configuration. Secure nuts and washers (not shown) are used to apply pressure via secure part 330 and 331 to the containers (not shown) between top shelf part 201 and bottom shelf part 205.

Figure 4:
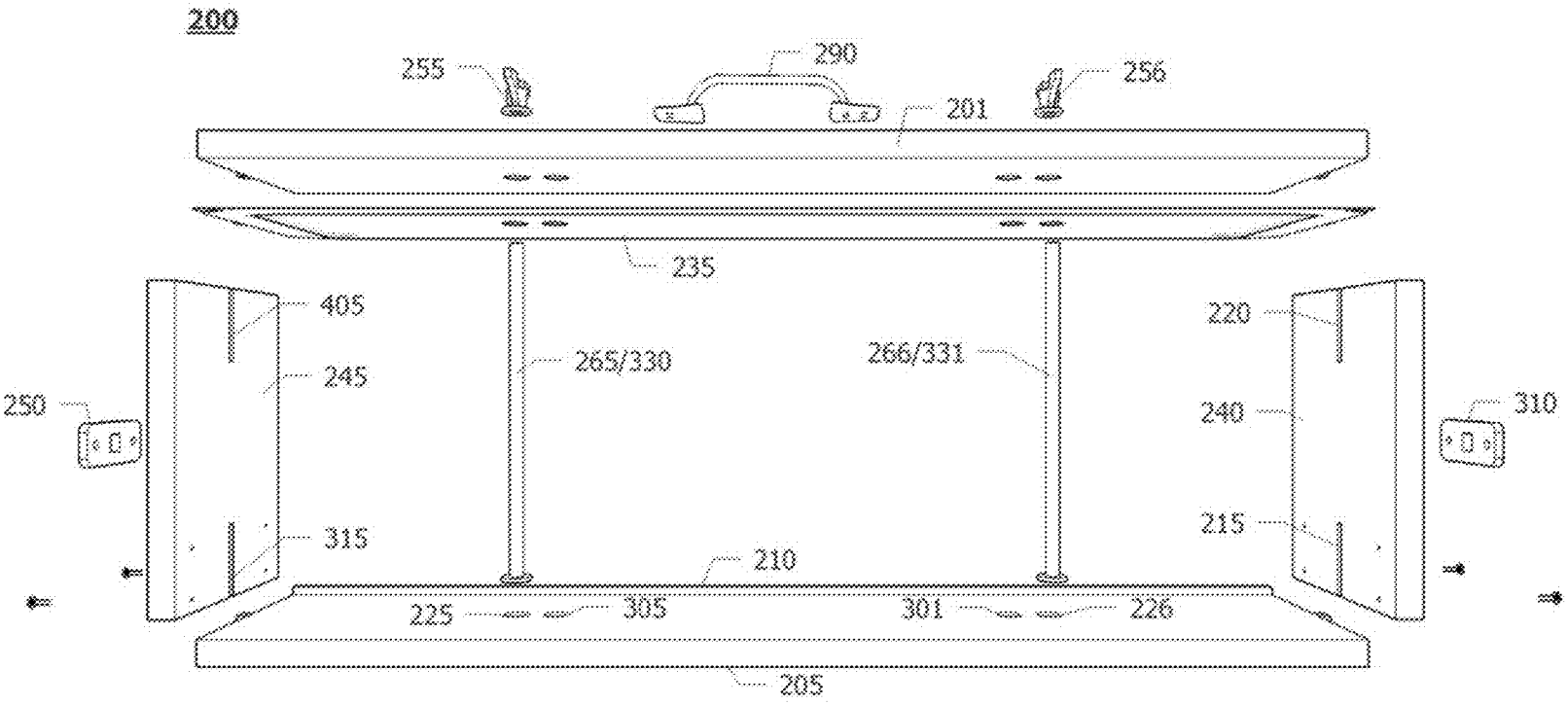
FIG. 4 is an exploded view of the liquid container mounting structure, according to an example embodiment.

Depicted in FIG. 4 is an exploded view of the liquid container mounting structure 200. In this view groove guide 405 is visible in which top shelf part 201 rides.

Figure 5:
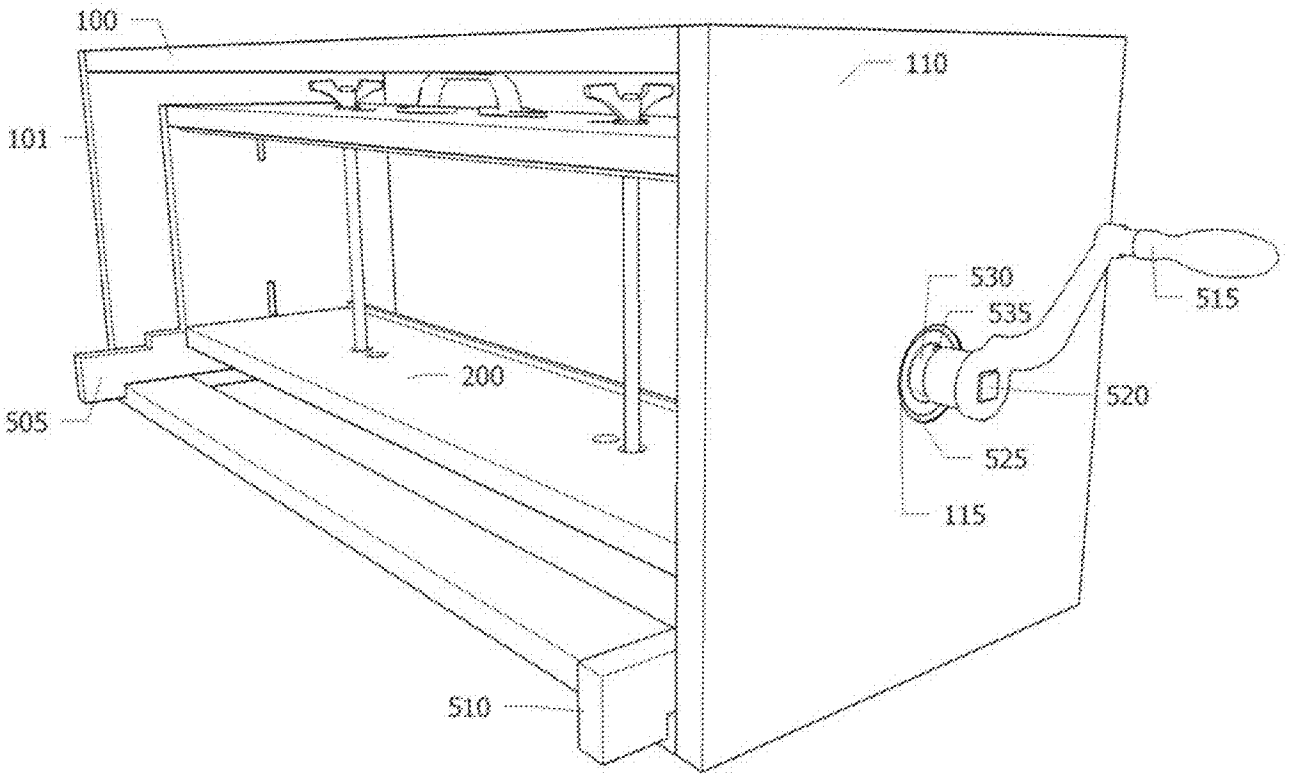
FIG. 5 illustrates a perspective view of the liquid container mounting structure mounted to a support structure with a crank handle, according to an example embodiment.

Depicted in FIG. 5 is the liquid container mounting structure 200 moveably mounted to the support structure 100. Parts 505 and 510 provide the liquid container mounting structure 200 support and alignment with the square drive shaft hole when removing or reloading from the support structure 100. Parts 505 and 510 also provide a spin locking mechanism for the liquid container mounting structure 200 when moveably mounted to the support structure 100. A ball bearing 525 outer race is securely attached within the receiving hole 115 on the support structure vertical part 110. Ball bearings reduce rotational friction when the liquid container mounting structure 200 rotates on the radial axis. The ball bearings also support the axial load of the liquid container mounting structure 200 by transferring the load to the rolling balls within the two races resulting in a much lower coefficient of friction than if two flat surfaces were rotating against each other.

A ball bearing insert 530 with a set screw 535 is mounted within the inner race of the ball bearing 525. The inner race of the ball bearing with the ball bearing insert rotates relative to the outer ball bearing race with a low coefficient of friction. A removable square drive shaft 520 is placed into the ball bearing insert 530 and through to mount to the shaft mounting part 310 on the liquid container mounting structure 200. The set screw 535 when tightened holds the square drive shaft 520 in place. As would be understood by the skilled artisan, support structure vertical part 101 may contain structures analogous to ball bearing 525, ball bearing insert 530, set crew 535, and square drive shaft 520. A manual crank handle 515 mounts to the square drive shaft 520 to provide for manual rotational energy. The manual crank handle 515 may be mounted on either or both of support structure vertical part 110 or support structure vertical part 101.

Figure 6:
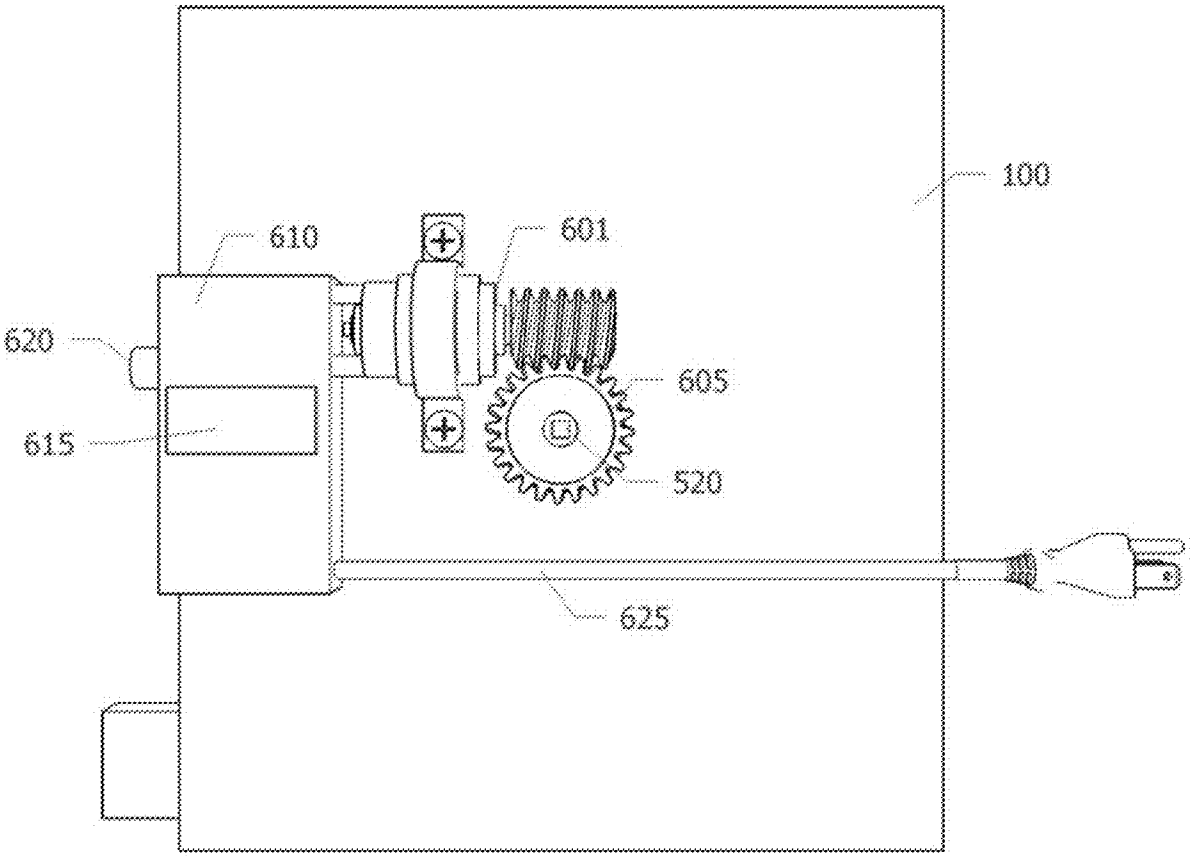
FIG. 6 is a side view of the liquid container mounting structure mounted to a support structure with an electric motor drive and user interface, according to an example embodiment.

Depicted in FIG. 6 is a side view of support structure 100 with an electric motor drive 601. Electric motor 601 may be attached to the side of the support structure 100. The electric motor may drive a gear 605 that is mounted to the square drive shaft 520 to provide rotational motion to the liquid container mounting structure at a configured speed and frequency. A motor controller 610 controls electric motor 601. Motor controller 610 may alter or determine the voltage to the electric motor 601, thereby altering the motion and/or speed at which electric motor drives gear 605. Controller 620 may receive user input via 620 or user interface screen 615. According to some example embodiments, controller 620 may be preprogrammed to control motor 601 based on, for example, the type of liquid arranged within support structure 100. Controller 620 may also adaptively control motor 610 based upon, for example, sensors measuring the fluid flow within liquid containers 810 (see FIG. 8). Power to the motor controller 610 is provided via electric chord 625. Electric power may be supplied to the electric motor via standard 120V, 60 Hz alternating current (AC) power. Other example embodiments may utilize battery powered motors and/or controllers. For example, electric power may be provided to motor 601 and controller 610 via a rechargeable battery. Any power conversion between AC and direct current (DC) is done via an internal transformer in motor controller 610 and/or motor 601. The motor 601 and controller 610 may be mounted to either side of the structure.

Figure 7:
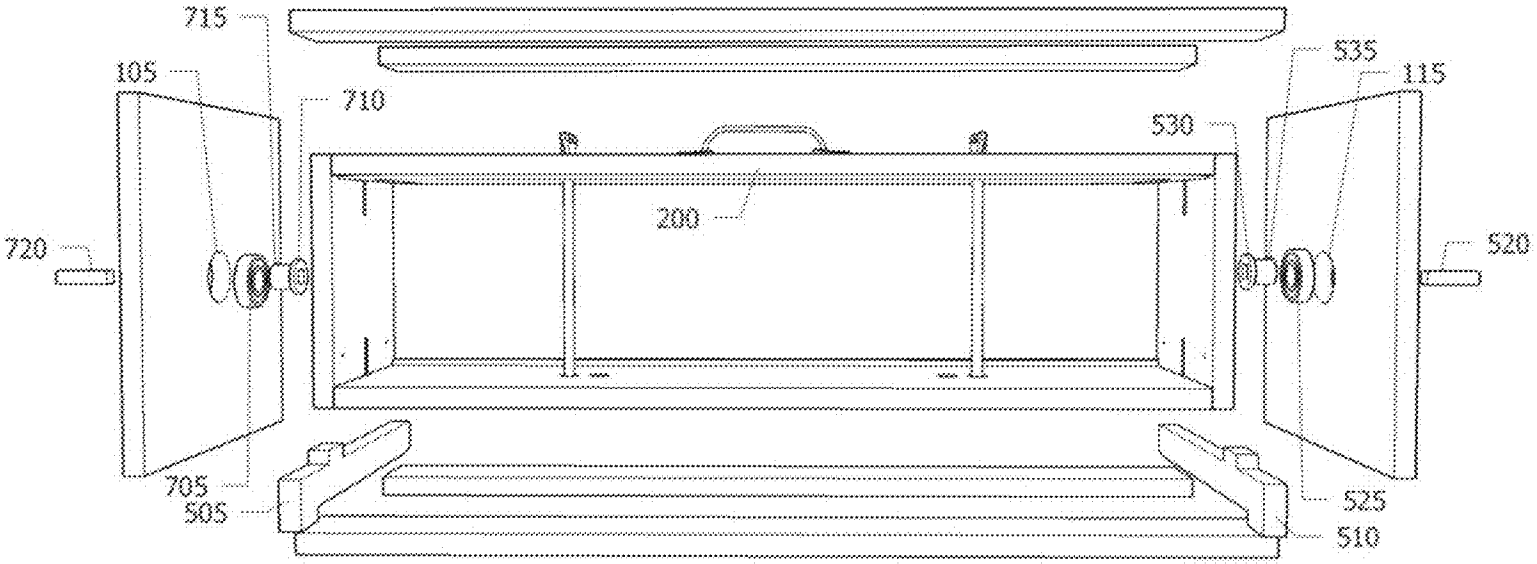
FIG. 7 is an exploded view of the support structure and drive parts with a liquid container mounting structure, according to an example embodiment.

Depicted in FIG. 7 is an exploded view of the support structure 100 and rotational parts around the liquid container mounting structure 200. The ball bearing insert 530 and set screw 535 can be seen in relation to the ball bearing 525. The ball bearing 525 attaches into hole 115. Drive shaft 520 inserts through ball bearing insert 530 and into square shaft mounting part 310 (not shown) on the liquid container mounting structure 200. On the opposite side of the unit, the ball bearing insert 710 and set screw 715 can be seen in relation to the ball bearing 705. The ball bearing 705 attaches into hole 105. Drive shaft 720 inserts through ball bearing insert 710 and into square shaft mounting part 250 (not shown) on the liquid container mounting structure 200. Ball bearing inserts 530 and 710 also feature a lip that act as a spacer to keep the liquid container mounting structure 200 adequately separated from the support structure 100 and also keeps the ball bearing inserts 530 and 710 from slipping within the ball bearings 525 and 705 while rotation occurs. The drive shafts 520 and 720 are accessible from the outside of the support structure 100 for attachment of crank handles or motors and for gripping to remove the drive shafts.

Figure 8:
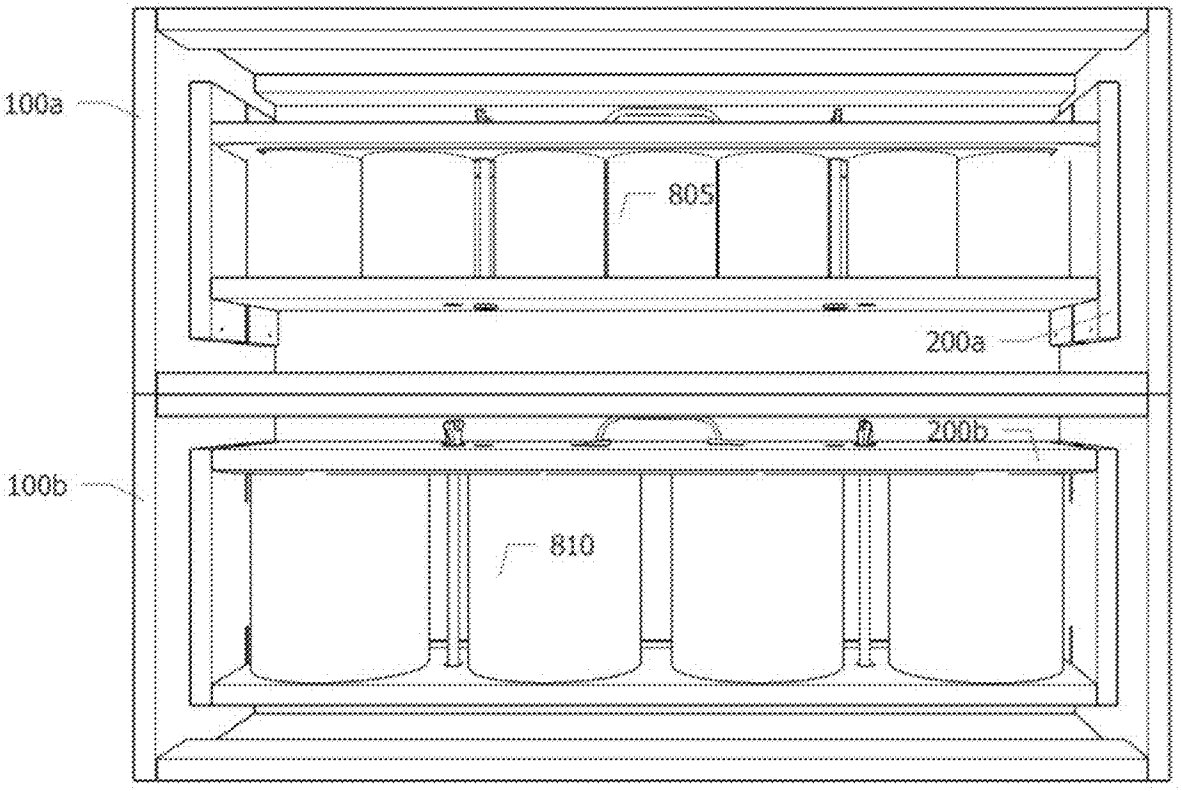
FIG. 8 illustrates stacked units configured for quarts and gallons, according to an example embodiment.

Depicted in FIG. 8 is an example of two units consisting of a support structure 100 and a liquid container mounting structure 200 stacked upon each other. The top unit 100*a* and 200*a* contains an example configuration with quart containers 805. The bottom unit 100*b* and 200*b* contains an example configuration with gallon containers 810.

Figure 9:
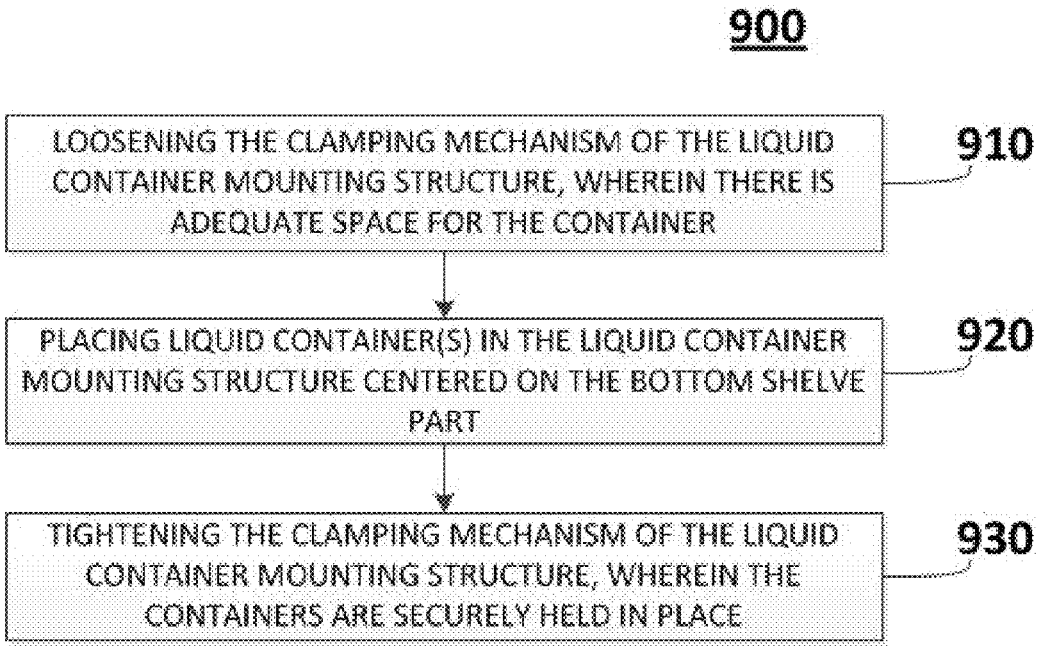
FIG. 9 is a flowchart illustrating an example process to place a container in the liquid container mounting structure, according to an example embodiment

Depicted in FIG. 9 is a flow chart illustrating a method for loading a container in the liquid container mounting structure such as module 200 of FIG. 2. The process begins in step 910 where the clamping mechanism of the mounting structure is loosened enough to allow shelf parts 201 and 205 to separate adequately enough to store container. In step 920 the container(s) are placed within the liquid container mounting structure as to rest on shelf 205 of FIG. 2. Finally in step 930 the clamping mechanisms 255 and 256 are tightened as to apply pressure on shelf 201 to the containers and onto shelf 205. The result is the containers are securely held in place within the liquid container mounting structure. A removal of the containers from the liquid container mounting structure follows the same method depicted in FIG. 9 but in reverse.

Figure 10:
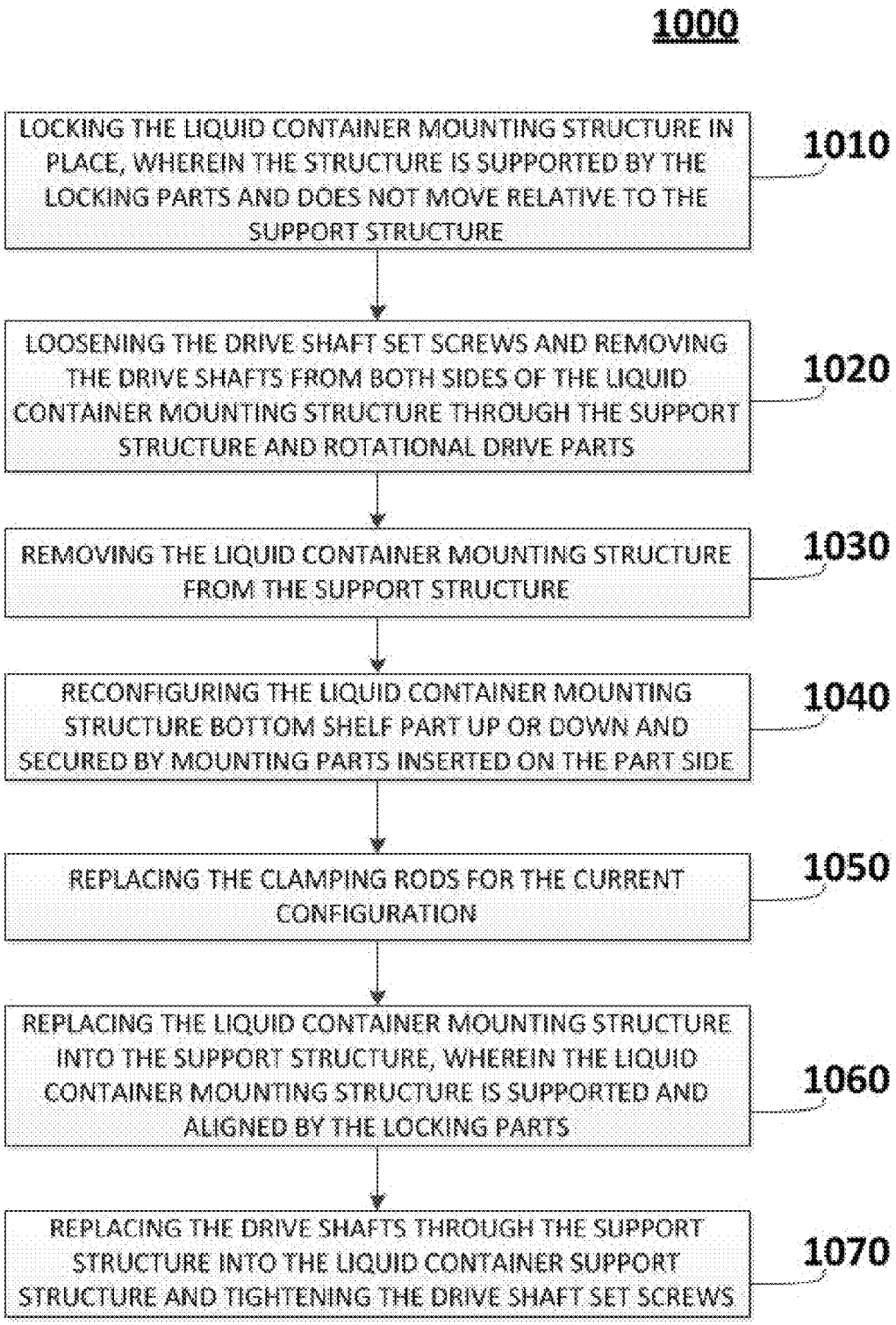
FIG. 10 is a flowchart illustrating an example process to remove the liquid container mounting structure from the support structure, reconfigure it, and then replace it back into the support structure, according to an example embodiment.

Depicted in FIG. 10 is flow chart illustrating a method for removing the complete liquid container mounting structure 200 from the support structure 100, reconfiguring the liquid container mounting structure, and replacing the liquid container mounting structure 200 into the support structure 100. The process begins in step 1010 where the liquid container mounting structure is locked and supported in place via locking parts 505 and 510. In step 1020 the drive shaft set screws 535 and 715 are loosened to allow the drive shafts 520 and 720 to be removed from the ball bearing inserts 530 and 710 and square shaft mounting parts 310 and 250. Step 1020 results in the liquid container mounting structure sitting freely on parts 505 and 510. In step 1030 the entire liquid container mounting structure 200 is removed from the support structure 100 and may be transported via carry handle 290. In step 1040, if the liquid container mounting structure is empty of any containers, the bottom shelf part 205 may be moved and remounted to the liquid container mounting structure side parts 240 and 245 at the desired setting using the mounting holes and parts such as parts 320 and 325 of FIG. 3. In step 1050 the appropriate sized clamping rods 265 and 266 or 330 and 331 for the configuration is placed in corresponding clamping rod holes 225 and 226 or 305 and 301. Secure nuts and washers 255 and 256 are then attached to the clamping rods. In step 1060 the reconfigured liquid container mounting structure 200 is replaced into the support structure 100 resting on locking parts 505 and 510 with the ball bearing inserts 530 and 710 and square shaft mounting parts 310 and 250 lined up. In the final step 1070 the square drive shafts 520 and 720 are inserted through the ball bearing inserts 530 and 710 and into the square shaft mounting parts 310 and 250. The drive shaft set screws 535 and 715 are tightened to securely hold the square drive shaft in place. When locking parts 505 and 510 are removed the entire liquid container mounting structure 200 is allowed to freely rotate about the horizontal axis supported by the support structure 100.

In other words, described herein is a method of storing a liquid in which kinetic energy is transferred to the liquid through the motion of the storage device to which a container for the liquid is mounted.

While the techniques illustrated and described herein are embodied in one or more specific examples, it is nevertheless not intended to be limited to the details shown, since various modifications and structural changes may be made therein without departing from the scope and range of equivalents of the claims.

What is claimed is:

1. An apparatus comprising:

a liquid container mounting structure comprising an attachment device, a support structure, and a drive mechanism, wherein the liquid container mounting structure is movably attached to the support structure to allow the liquid container mounting structure to move relative to the support structure, wherein the drive mechanism mechanically moves the liquid container mounting structure relative to the support structure;

wherein the attachment device secures a liquid container to the liquid container mounting structure preventing motion of the liquid container relative to liquid container mounting structure as the drive mechanism moves the liquid container mounting structure relative to the support structure, wherein the liquid container mounting structure is rotatably coupled to the support structure such that the drive mechanism provides a complete rotation of the liquid container as the drive mechanism moves the liquid container mounting structure relative to the support structure, wherein the support structure comprises a pivot point, and wherein the liquid container mounting structure is rotatably attached to the pivot point to allow rotation of the liquid container mounting structure to completely rotate relative to the support structure, and wherein the drive mechanism comprises a linear electric motor.

2. The apparatus according to claim 1, wherein the liquid container mounting structure comprises a first shelf part.

3. The apparatus according to claim 2, wherein the attachment device comprises a moveable second shelf part, wherein the second shelf part clamps the liquid container between the second shelf part and the first shelf part.

4. The apparatus according to claim 1, wherein the attachment device comprises at least one of a clamp, a strap or a latch.

5. The apparatus according to claim 1, further comprising a crank shaft arranged between the drive mechanism and the liquid container mounting structure, wherein the crank shaft converts the linear motion of the linear electric motor to rotational motion of the liquid container mounting structure.

6. The apparatus according to claim 1, wherein the complete rotation of the liquid container corresponds to a 360° rotation of the of the liquid container mounting structure about the pivot point.

7. The apparatus according to claim 1, wherein the drive mechanism provides a plurality of complete rotation of the liquid container as the drive mechanism moves the liquid container mounting structure relative to the support structure.

8. The apparatus according to claim 1, wherein the attachment device comprises threaded clamps.

9. An apparatus comprising:

a liquid container mounting structure comprising an attachment device;

a support structure;

a drive mechanism, wherein the drive mechanism comprises a linear electric motor; and a crank shaft arranged between the drive mechanism and the liquid container mounting structure, wherein the crank shaft converts the linear motion of the linear electric motor to rotational motion of the liquid container mounting structure, wherein the liquid container mounting structure is movably attached to the support structure to allow the liquid container mounting structure to move relative to the support structure, wherein the drive mechanism mechanically moves the liquid container mounting structure relative to the support structure;

wherein the attachment device secures a liquid container to the liquid container mounting structure preventing motion of the liquid container relative to liquid container mounting structure as the drive mechanism moves the liquid container mounting structure relative to the support structure.

10. The apparatus according to claim 9, wherein the support structure comprises a pivot point, and wherein the liquid container mounting structure is rotatably attached to the pivot point to allow rotation of the liquid container mounting structure relative to the support structure.

11. The apparatus according to claim 9, wherein the liquid container mounting structure comprises a first shelf part.

12. The apparatus according to claim 11, wherein the attachment device comprises a moveable second shelf part, wherein the second shelf part clamps the liquid container between the second shelf part and the first shelf part.

13. The apparatus according to claim 9, wherein the attachment device comprises at least one of a clamp, a strap or a latch.

* * * * *